United States Patent [19]

Beghetto et al.

[11] Patent Number: 4,687,062

[45] Date of Patent: Aug. 18, 1987

[54] UNDERSEA TEMPLATE FOR THE DRILLING OF WELLS FOR THE EXPLOITATION OF HYDROCARBON POOLS UNDER THE SEA

[75] Inventors: Leonardo Beghetto, Venice; Giovanni Padovan, Arsie', both of Italy

[73] Assignee: Technomare S.p.A., Venice, Italy

[21] Appl. No.: 600,335

[22] Filed: Apr. 13, 1984

[30] Foreign Application Priority Data

Apr. 18, 1983 [IT] Italy ..... 84110 A/83

[51] Int. Cl.[4] ..... E21B 33/047

[52] U.S. Cl. ..... 166/366; 405/227; 175/7

[58] Field of Search ..... 166/366, 349, 341; 175/7; 405/227, 225, 211

[56] References Cited

U.S. PATENT DOCUMENTS

| | | | |
|---|---|---|---|
| 4,155,672 | 5/1979 | Franks | 405/211 |
| 4,183,698 | 1/1980 | Coone | 405/227 |
| 4,212,562 | 7/1980 | Stone et al. | 166/366 |
| 4,405,261 | 9/1983 | Lawson | 166/366 |

FOREIGN PATENT DOCUMENTS

| | | | |
|---|---|---|---|
| 2054710 | 2/1981 | United Kingdom | 405/227 |

*Primary Examiner*—George A. Suchfield

*Assistant Examiner*—William P. Neuder

*Attorney, Agent, or Firm*—Birch, Stewart Kolasch & Birch

[57] ABSTRACT

The present invention relates to an undersea template for the drilling of wells for the exploitation of hydrocarbon pools under the sea, which template is of variable dimensions and form so as to be able to adapt to any spacing and number of wells, and which is anchored to the seabed by mooring piles and provided with suitable well slots, characterized by the fact that the vertical restraint between the template and the well slots, or between the well slots and the anchorage column of the drill, or between the template and its mooring piles, consists of a flexible member which allows the weight bearing on the template to be reduced to the sole weight of the anchorage columns, with consequent weight reduction of the template itself. The template, moreover, is provided with a particular system of levelling acting between the mooring piles and the respective well slots which allows the template to be installed on beds of any kind since the levelling system in question consists of movement devices which can be positioned inside or outside the said piles, or on the well slots or on the template, provided they act between the template and the relative mooring piles so as to allow the necessary levelling to be made.

4 Claims, 8 Drawing Figures

UNDERSEA TEMPLATE FOR THE DRILLING OF WELLS FOR THE EXPLOITATION OF HYDROCARBON POOLS UNDER THE SEA

The present invention relates to an undersea template for the drilling of wells for the exploitation of hydrocarbon pools under the sea, which template enables the drilling of undersea wells to be performed in a straightforward, economical and time-saving manner through the instrumentality of a light-weight structure which is readily levelled with the sea bed and secured to the underlying terrain by cemented mooring piles.

In the exploitation of undersea hydrocarbon deposits particular systems, called early production systems, are already known, and they consist in laying on the seabed, a long time before the setting-up of the platform and rig, a submarine structure or drilling template, more commonly termed simply "template", provided with well slots through which the wells are drilled so that, when the platform and rig are completed and installed, production can be started at once, with the greatest possible number of wells having been drilled beforehand.

There are in fact known from the state of the art various types of submarine templates that are secured to the seabed by mooring piles which ensure their stability. Such templates can have a varying number of well slots, and their form and dimensions depend on the exigencies of the exploitation system employed.

In any case, they are normally heavy structures, in that they are required to bear all the loads originating from the production columns and the undersea shut-off valves; and they must be sufficiently strong to bear such loads and at the same time be flexible (compatibly with strength) so as to transfer onto the production column anchorage columns the greatest possible proportion of load. Moreover, for the purpose of identifying the worst load condition in order to size the structure, it is necessary to analyze the possible sequences of drilling of the various wells or pre-establish a sequence which the drilling operator will be obliged to follow.

Structural analysis in any case entails following the different phases of drilling for each single well and the order of drilling, and this means that the times required for calculation are increased and that the costs for finalizing the overall system are likewise increased.

Since one of the basic requirements of such early production systems employing templates is to drill the greatest number of wells possible while the remaining components of the deposit exploitation system (platform, deck, rig, etc.) are being designed and built, the time required for designing, constructing and installing the template must be reduced to a minimum.

In the presence of soft, muddy or uneven seabeds it also becomes necessary to provide for particular levelling systems if the installed structure is to remain permanently in the horizontal position so that the vertical positioning of the production column during the drilling steps can be controlled.

The fact is, however, that the template systems known from the state of the art entail a series of difficulties regarding the aforesaid problems, and more exactly:

the prior art systems possess a high template weight and relatively long designing times, with resulting negative influence on the operations of constructing and installing the template;

it is binding upon the drilling contractor to follow a certain pre-set operating sequence; and the undersea levelling operations are complicated and costly.

The object of the present invention is to obviate the aforesaid difficulties.

A description of the invention is given below, with reference to the attached drawings which illustrate a preferred form of a practical embodiment which is provided for exemplification purposes only and thus is not limiting of the present invention, in that it is always possible to make technical and constructional variants thereof without going beyond the scope of the present invention.

The present invention will become more fully understood from the detailed description given hereinbelow and the accompanying drawings which are given by way of illustration only, and thus are not limitative of the present invention, and wherein.

Figure 3:
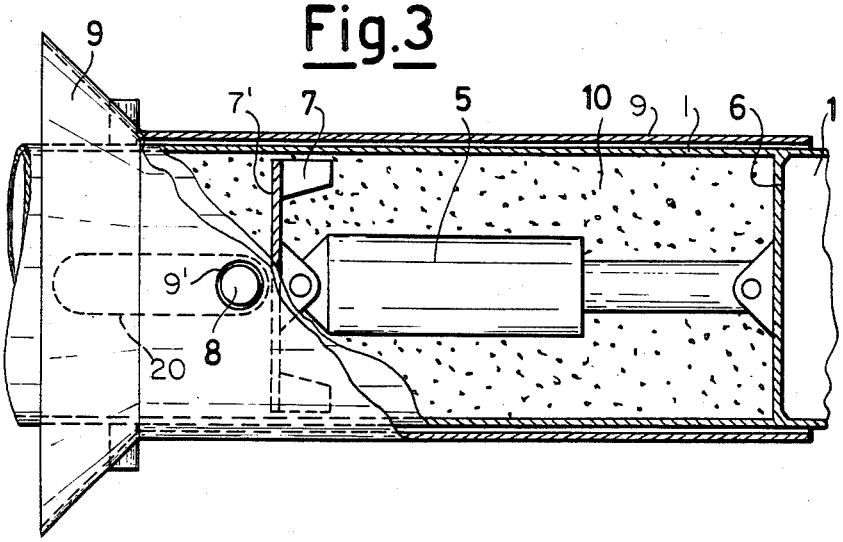
FIG. 3 shows the levelling system utilized.
Figure 5:
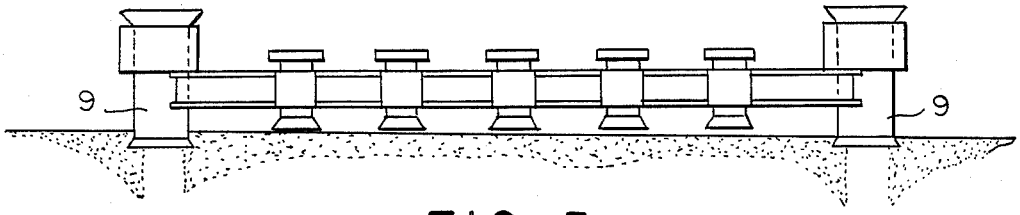
FIG. 5 shows a template being placed on a seabed and holes which are drilled into the seabed for receiving the mooring piles.
Figure 7:
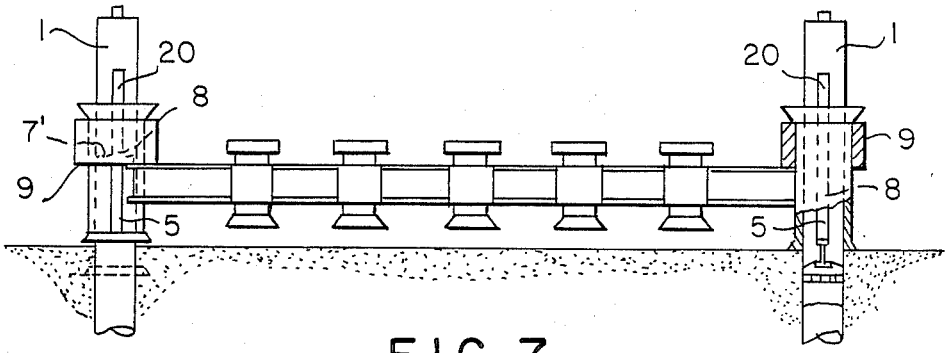
Figure 8:
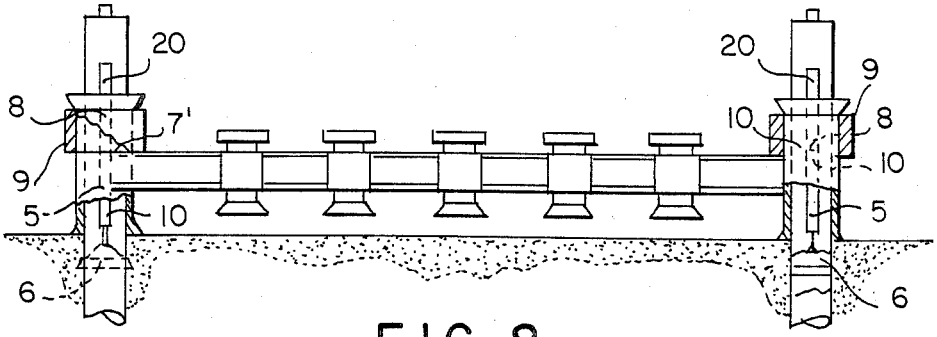

FIG. 7 shows the template leveling operation after the drilling of FIG. 5 and the cementing of the mooring piles 1 are carried out using the system of FIG. 3; and FIG. 8 shows the cementing of the leveling system and the annular space between the pile and the guiding tube, after the completion of the leveling step. Because of the cementing operation, the hoisting assembly does not function as a load-sustaining member.

The submarine or undersea template, the dimensions and form of which are wholly without importance inasmuch as the template in question is able to adapt to any spacing and number of wells, is anchored to the seabed by mooring piles 1 and is provided with a certain number of intermediate guiding tubes or well-head based receptacles 2 for the installation of the anchorage columns 3 and of the production columns 4. The operations of levelling the template after drilling and the cementing of the mooring piles 1 are carried out using the system shown in FIG. 3. The levelling system is located in the upper part of the mooring piles 1 of the template and consists of a hoisting system 5 (jack or the like) securing on one end to a diaphragm 6 within each mooring pile. The free end is secured to plate 7' which is appropriately guided by guides 7 in its longitudinal travel, which interacts with a pin 8 which passes through a through-hole 9' and which also passes through the well slot 20 of the mooring pile. The terminal guiding tube structure or sleeve 9 is in telescopic relationship with the mooring piles 1.

When levelling is complete, the system is cemented with usual materials 10 using usual cementing techniques, and the hoisting system does not necessarily have to act as a load supporting means.

The principal advantage of this system is that it allows the template to be levelled on any type of seabed, even very soft and muddy seabeds, and also minimizes marine operations on the seabed, since such operations are limited to activation of the abutment 8 between well slot 20 and foundation 1 of the foundation system and to actuating the hoisting device 5; such undersea operations can also be carried out from the surface by remote-control systems whenever the depth of the seabed justifies this.

Figure 4:
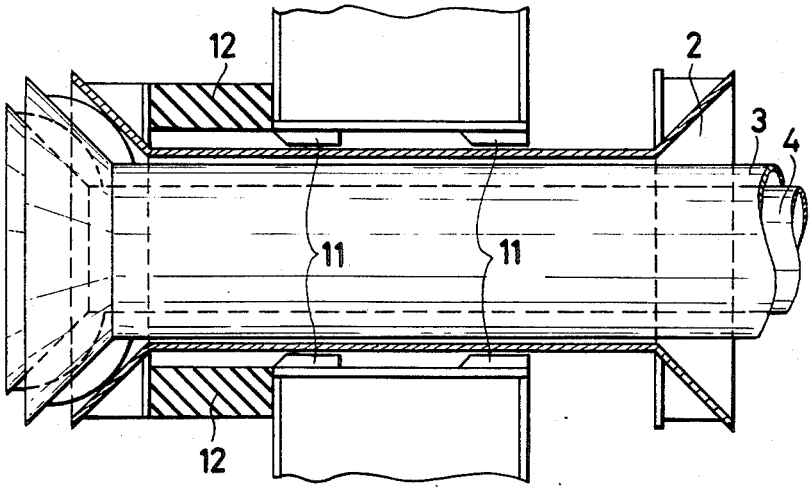
FIG. 4 shows a typical detail of the well slots of the production column.

FIG. 4 shows a typical detail of the guiding tube 2 for the installation of the production columns 4.

The guiding tube 2 is restrained as regards horizontal movement and rotation about any horizontal axis by sliding restraints 11 which do not however prevent translation along the vertical axis of the said guiding tube.

The vertical restraint between the guiding tube and the template consists of a flexible member 12 (e.g. rubber), which so acts so that the template has to bear the weight of the anchorage column 3 during the operations of cementing thereof. The increase in the load for the template when the other stays of the production column 4 are installed and cemented is negligible, due to the high degree of deformability of the flexible member with respect to the anchorage column 3, and the entire weight of the production column comes to bear on itself, i.e. on the terrain and not on the template.

The chief advantages of this flexible connection are:

the worst load condition for the template is immediately defined and the template can be sized immediately and in a very straightforward manner;

the possibility of sizing the template when only the anchorage columns have been finalized, without having to wait for finalization of the entire production column, which means that any changes to the production column that may become necessary can be made at any time;

the weight of the template is remarkably small, in that the template bears only the weight of the anchorage columns instead of the total of its own weight, the weight of part of the drilling column and the weight of the well head shut-off values; this means a very considerable economy both with respect to construction times and construction costs, as well as installation costs (smaller seagoing means, lighter-weight anchorage piles, etc.);

the operator is not required to follow any particular sequence in drilling the wells, inasmuch as such sequence in no way influences the final condition of the load of the template.

Figure 1:
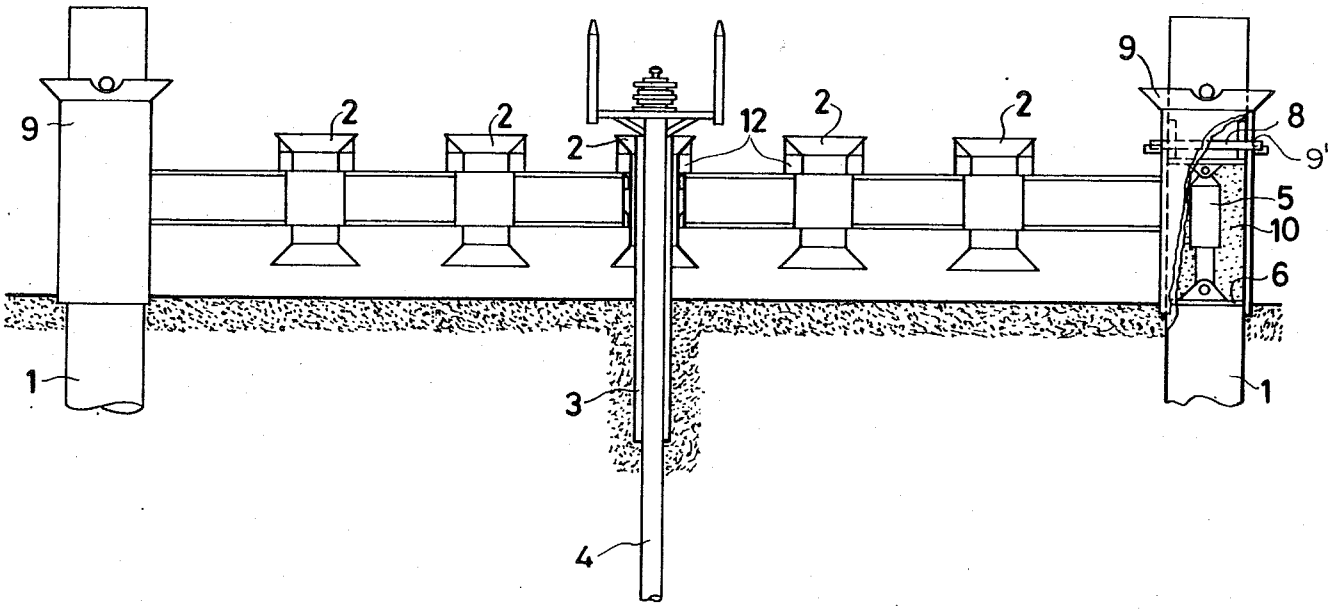
FIG. 1 is an elevational view of the structure with the details of only one of the production columns and of only one of the mooring piles and of the levelling system.
Figure 2:
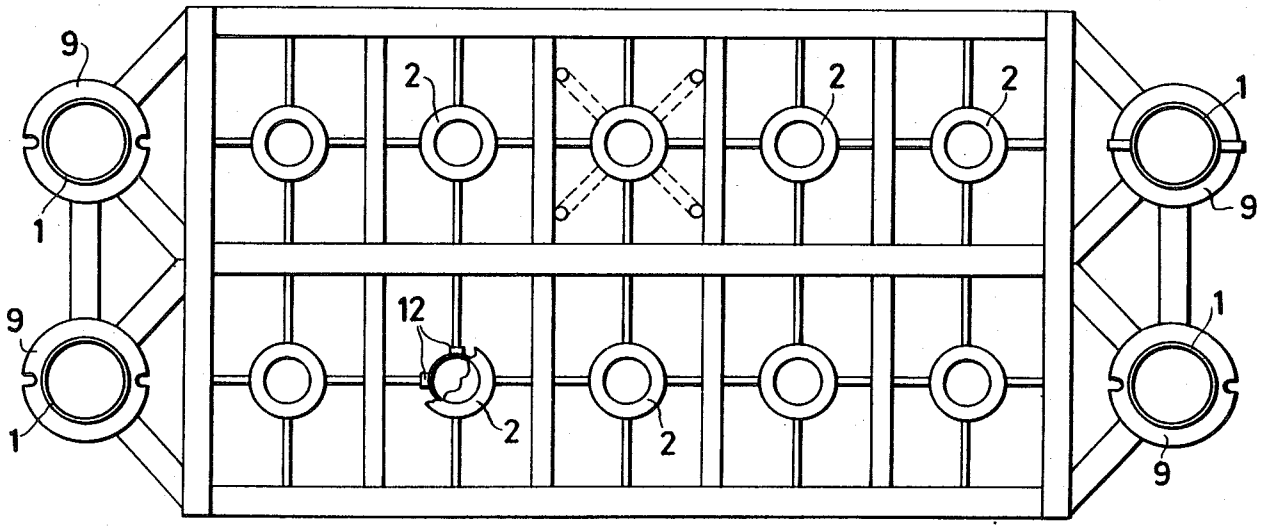
FIG. 2 is a top view of the structure.
Figure 6:
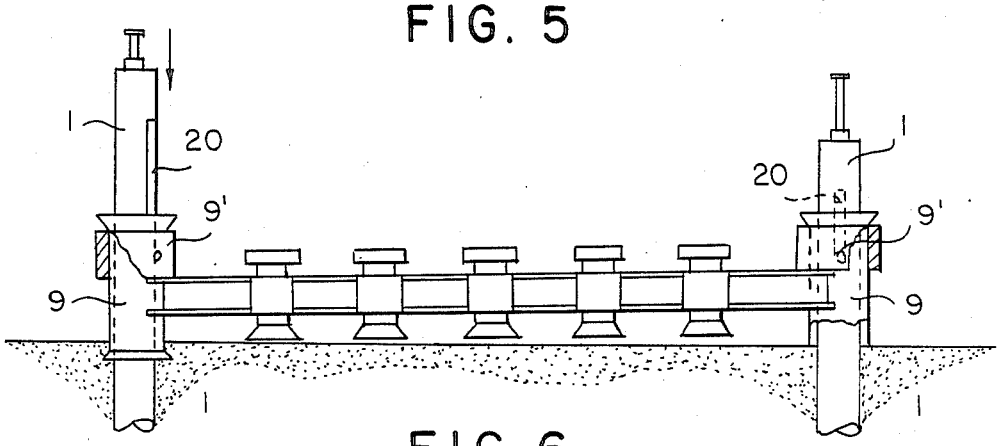
FIG. 6 shows mooring piles being driven into the drilled holes shown in FIG. 5, prior to cementing the piles in place.

In operation, and as shown in FIG. 5, the template is placed on the seabed. Holes are drilling for receiving the mooring piles as shown in FIG. 6,. mooring piles 1 are driven into the drilled holes prior to cementing the piles. Template-leveling operations after drilling and cementing mooring piles 1 are carried out as shown in FIG. 7, using the system shown in FIG. 3. The leveling system is placed on the top of the mooring piles and consists of the hoisting system 5 (a jack or a like implement) which is secured at its lower end to the diaphragm 6 within each mooring pile. The top section of the hoisting system is fastened to the plate 7'. Plate 7' coacts with the horizontal pin 8 which passes through a through-hole 9' (See FIGS. 1 and 3) formed through the guiding tube 9 and is properly guided by guide slots 20 of the mooring piles during its vertical motion. As the hoisting system 5 is actuated, the plate 7' interacts with pin 8 (the pin is integral with the guiding tube 9) whereby tube 9 is lifted together with the template structure, while the cemented mooring piles 1 remain in a fixed posture. As seen in FIG. 8, upon completion of the leveling step, the leveling system and the annular space between the pile and the tube 9 is cemented with cement 10. The hoisting assembly 5 therefore does not compulsorily work as a load-sustaining means.

We claim:

1. An undersea template for the drilling of wells for the exploitation of marine hydrocarbon pools which comprises a template having variable dimensions and containing sleeves at the end portions thereof as well as a plurality of intermediate guiding tubes, through which anchorage columns and production columns for wells are to be drilled, said intermediate guiding tubes being disposed intermediate said sleeves and spaced apart in any desired configuration, mooring piles telescopically extending through said sleeves for anchoring the template to the seabed, and a flexible member disposed between the template and the intermediate guiding tubes or between the sleeve and the mooring piles whereby the weight bearing on the template is the sole weight of the anchorage columns.

2. The undersea template of claim 1, wherein a leveling system is operatively associated with the mooring piles and the sleeves whereby the sleeves and corresponding template can be moved relative to the mooring piles for leveling the template.

3. The undersea template of claim 2, wherein means are provided for cementing the sleeves with the mooring piles together with the leveling system whereby the mooring piles and not the leveling system become the load-sustaining means.

4. The undersea template of claim 2, wherein remote control means are operatively associated with the leveling means for leveling the template.

* * * * *

UNITED STATES PATENT AND TRADEMARK OFFICE

CERTIFICATE OF CORRECTION

PATENT NO. : 4,687,062

DATED : Aug. 18, 1987

INVENTOR(S) : Beghetto et al.

It is certified that error appears in the above-identified patent and that said Letters Patent is hereby corrected as shown below:

In the category "[73] Assignee:" change "Technomare S.p.A., Venice, Italy" to --Tecnomare S.p.A., Venice, Italy--.

Signed and Sealed this

Second Day of August, 1988

*Attest:*

*Attesting Officer*

DONALD J. QUIGG

*Commissioner of Patents and Trademarks*